US008028751B2

(12) United States Patent
Pinto et al.

(10) Patent No.: US 8,028,751 B2
(45) Date of Patent: Oct. 4, 2011

(54) PERFORATION METHOD AND APPARATUS

(75) Inventors: C. Jason Pinto, Shenzhen (CN); Stephen R. Thompson, Bakersfield, CA (US); David O. Johnson, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/423,644

(22) Filed: Apr. 14, 2009

(65) Prior Publication Data

US 2009/0200021 A1 Aug. 13, 2009

Related U.S. Application Data

(63) Continuation of application No. 10/937,649, filed as application No. PCT/US03/09156 on Mar. 24, 2003, now abandoned.

(60) Provisional application No. 60/368,032, filed on Mar. 27, 2002.

(51) Int. Cl.
*E21B 43/119* (2006.01)

(52) U.S. Cl. ..... 166/255.2; 175/4.51

(58) Field of Classification Search ..... 166/255.1, 166/255.2, 254.1, 55, 55.1, 241.5, 241.6, 166/297; 175/4.51
See application file for complete search history.

(56) References Cited

U.S. PATENT DOCUMENTS

| | | | |
|---|---|---|---|
| 2,728,554 | A | 12/1955 | Goble |
| 3,426,850 | A | 2/1969 | McDuffie, Jr. |
| 3,704,749 | A | 12/1972 | Estes et al. |
| 3,706,344 | A | 12/1972 | Vann |
| 3,776,323 | A | 12/1973 | Spidell et al. |
| 3,812,911 | A | 5/1974 | Vann |
| 3,871,448 | A | 3/1975 | Vann et al. |
| 3,931,855 | A | 1/1976 | Vann et al. |
| 4,040,485 | A | 8/1977 | Vann et al. |
| 5,138,876 | A | 8/1992 | Moore et al. |
| 5,259,466 | A | 11/1993 | Venditto et al. |
| 5,318,123 | A | 6/1994 | Venditto et al. |
| 5,582,248 | A | 12/1996 | Estes |
| 6,003,597 | A | 12/1999 | Newman |
| 6,003,599 | A | 12/1999 | Huber et al. |
| 6,032,739 | A | 3/2000 | Newman |
| 6,065,540 | A | 5/2000 | Thomeer et al. |
| 6,173,773 | B1 | 1/2001 | Almaguer et al. |
| 6,378,607 | B1 | 4/2002 | Ryan et al. |
| 6,508,307 | B1 | 1/2003 | Almaguer |
| 6,837,310 | B2 | 1/2005 | Martin |
| 7,000,699 | B2 | 2/2006 | Yang et al. |
| 7,114,564 | B2 | 10/2006 | Parrott et al. |
| 2004/0238167 | A1 | 12/2004 | Pinto et al. |
| 2008/0264639 | A1 | 10/2008 | Parrott |

FOREIGN PATENT DOCUMENTS

| | | | |
|---|---|---|---|
| WO | 0075485 | A1 | 12/2000 |
| WO | 03083248 | A2 | 10/2003 |

OTHER PUBLICATIONS

Office Action issued Jan. 13, 2005, for U.S. Appl. No. 10/445,494, 6 pages.

(Continued)

*Primary Examiner* — David Andrews
(74) *Attorney, Agent, or Firm* — Marlin R. Smith

(57) ABSTRACT

A signature element is attached to a downhole cable or other protected equipment and the signal from a signature position detector is used, at least in part, to control the orientation of a directed perforating device or other directional device. Signal emitting sources can include a radioactive material added to an encapsulating composition of a downhole cable.

2 Claims, 5 Drawing Sheets

OTHER PUBLICATIONS

International Search Report issued May 21, 2004, for International Application Serial No. PCT/US03/09156, 2 pages.
Almaguer, Jim, Manrique, Jorge, Wickramasuriya, Saliya, et al., Orienting Perforations in the Right Direction, Oilfield Review, Spring 2002, pp. 16-31.
Gadeken, L.L., Fox, P.A., Brumley, J.L., et al., Enhancing Frac-Pack Evaluations with Directional and Spectral Gamma Ray Measurements, SPE38589, Oct. 5-8, 1997, pp. 241-253.

PERFORATION METHOD AND APPARATUS

CROSS-REFERENCE TO RELATED APPLICATIONS

This application is a continuation of U.S. patent application Ser. No. 10/937,649, filed Sep. 9, 2004, which is a national stage filing under Chapter II of the Patent Cooperation Treaty of International Application No. PCT/US03/09156, filed Mar. 24, 2003, which claims priority to U.S. Provisional Application No. 60/368,032 filed Mar. 27, 2002. The entire disclosures of these prior applications are incorporated herein by this reference.

BACKGROUND

This invention in part, relates to well drilling and completion devices and processes. More specifically, the invention, in part, is concerned with providing devices and methods that improve the ability to azimuthally orient perforating devices away from downhole cables within a perforating zone.

Conventional wells and well completions typically provide little or no downhole instrumentation and/or fluid control capability. Some conventional well completion procedures are relatively simple, essentially running production or injection tubing into the well along with perforating, gravel packing, and/or logging steps as needed. Pressure and flow control in conventional oil, gas or other fluid-producing wells typically use valves and instruments located at or near the surface in a Christmas tree arrangement. Formation fluids are typically produced until a downhole problem occurs, e.g., reservoir pressure declines or the water-cut increases or something else happens downhole that significantly reduces production or prevents the well from further commercial operation.

To evaluate the cause of production or injection problems in a conventional well, the well is typically taken off-line and one or more logging tools supported by a wireline are run through the tubing within the well. The logging tools may be used to check downhole fluid pressures, fluid types, zonal flowrates or other parameters at one or more depths to try to determine the cause of the production or injection decline and the corrective action needed. Once the problem is determined and/or new production or injection zones identified, the wireline tools are typically removed and a second re-entry into the off-line well is accomplished to correct the problem, e.g., using a workover rig. For example, a second re-entry might lower a perforating tool to re-perforate/re-complete the well at a new producing level. These conventional well completions, re-entries, and re-completions may consume unacceptable lost production time and costs, especially when applied to deepwater, multi-producing zone, high temperature, and/or high-pressure reservoirs and wells.

In contrast to conventional wells and well systems, the term "intelligent" and "smart" wells and well systems may refer to wells having downhole process control, instrumentation, and/or related components. Other terms used for intelligent or smart well systems include SCRAMS (Surface Controlled Analysis and Management System), IRIS (Intelligent Remote Implementation System), and RMC (Reservoir Monitoring & Control).

But no matter what these well systems are called, they enable real-time downhole operation, surveillance, data interpretation, intervention, and/or process control in a continuous feedback loop. The smart wells allow problems to be detected and possibly minimized or corrected without taking the well off-line. Smart well systems can therefore operate for long periods without the need to shut down and introduce instrumentation or additional wireline tools. However, the introduction of perforating tools is still typically required during the less frequent workover processes.

A smart well system typically uses downhole tubing, cables or other means for transmitting power, real-time data or control signals to or from surface equipment and downhole devices such as transducers and control valves. Power and signals typically use transmission means such as electric and/or fiber optic cables, but other transmission devices can include fluid tubing.

Other well applications may also have cables or other transmission means present during operations that may include perforating. Other well processes and applications that may require downhole transmission means include wells having a submersible electric pump, measurement while drilling (MWD) methods, and the use of downhole directional & inclination indicators, hydraulic actuators, and power supplies, e.g., for data transmission using mud pulse telemetry.

Perforating or re-perforating a well having a downhole cable or other transmission device must avoid damaging the transmission device during the perforating process, typically requiring a step of azimuthally orienting a directional-perforating device. The orienting step directs the perforating action away from nearby cables or other devices in the well. Orientating methods may include magnetic oriented techniques (MOT), obtaining positional data from downhole probes, using gravity-actuated orienting devices for non-vertical boreholes, limiting operations to within guided downhole paths, obtaining orienting data from gyroscopes, and using mechanical indicators or orientation subs.

However, the orienting step can add significant cost and/or present feasibility problems, especially when high temperature, corrosive fluids, high pressures, multiple completion zones, or other difficult downhole conditions are encountered. The added costs and problems can also be compounded by the added time to accomplish the orienting step for deep offshore wells. For example, application of current MOT techniques may be limited by high downhole temperatures and since typical well depths have been increasing, increasing downhole temperature problems for MOT processes may be encountered.

SUMMARY

In one embodiment, the invention adds a position signaling or a detectable signature element to a cable or other equipment to be protected and a signal or signature position detector that, at least in part, controls the orientation of a directed perforating device. The detection of the position signal or signature allows the perforating device to be oriented in a desired azimuthal position that avoids damaging the cable. Signal emitting sources can include a radioactive material added to an encapsulating composition of a downhole cable or an irradiated Cobalt alloy wire along with electric wires in the cable. Various types of signal detectors can be used, e.g., a Geiger, Mueller, or scintillation counter, combined with a moveable apertured shield or another directional device, e.g., a Rotascan and/or Tracerscan model manufactured by Halliburton and available in Houston, Tex. or a POT-C manufactured by Schlumberger and available in Houston, Tex. The position signal detector assembly is preferably connected to a scallop, strip gun, or other conventional directed perforating tool (e.g., a Model OP perforating tool supplied by Halliburton) in such a way that perforations are directed away from the detected cable or cable assembly. Connecting the directed perforating tool and the signal detector allows a reliable perforation and re-perforation of the well without re-entry and without damage to the cable or other downhole equipment not intended to be perforated.

BRIEF DESCRIPTION OF THE DRAWINGS

In these Figures, it is to be understood that like reference numerals refer to like elements or features.

DETAILED DESCRIPTION

Figure 1:
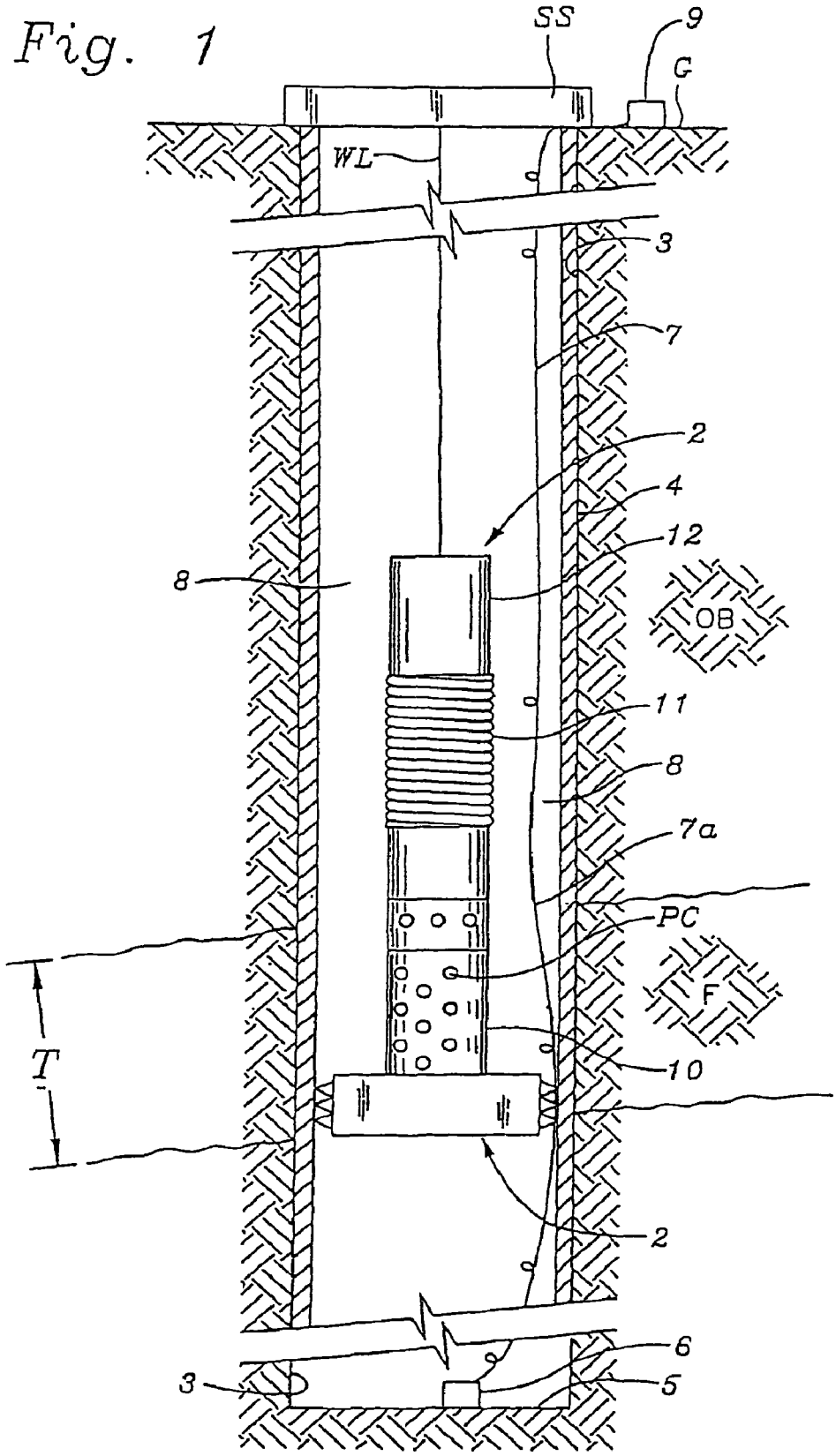
FIG. 1 shows a side cross-sectional view of an embodiment of an inventive assembly within an underground wellbore.

FIG. 1 shows a side cross-sectional view of a wellbore 3 having an inventive position emitter or signature device included with cable 7 or other device to be protected from being perforated and a perforating & position-detecting tool assembly 2. The wellbore 3 extends through overburden OB and penetrates a formation of interest F to be perforated. In the embodiment of the invention shown, the tool assembly 2 is suspended within the wellbore 3 on a slickline or wireline WL and supported by a drilling rig, well workover equipment, or other support structure SS. Installed within a portion of the wellbore 3 is a casing string or other well tubular 4 extending generally downward from at or near a ground surface G, but not necessarily extending the entire length of the wellbore to the well bottom 5.

In the embodiment shown, a downhole pressure transducer or other downhole signal-handling device 6 is located below the tool assembly 2 at or near the well bottom 5. The pressure transducer 6 produces an electrical signal representative of downhole fluid pressure. The pressure-representing electrical signals are transmitted through a cable 7 (e.g., a coaxial cable, conduit, or other transmitting means) that extends within an annular space 8 (typically filled with fluid) past the tool assembly 2 to a data recorder 9 or other upper signal-handling means located above the tool assembly, e.g., at or near the ground surface G. In other embodiments, the lower or downhole signal handling device 6 may be replaced or supplemented by other signal, fluid, or power consuming devices, e.g., a submersible pump, or other signal handling means such as a well logging tool, a distributed temperature sensor (DTS) system, a localized temperature sensor, an inflow control valve (ICV), a fluid density sensor, a two or three-phase flow meter, a fiber optic viewer, or other well downhole tools, instrumentation, and control devices. The cable 7 is preferably a coaxial cable assembly, but other transmission means may be used to replace or supplement the coaxial cable.

Although FIG. 1 shows the transducer 6 located at or near the well bottom 5, alternative downhole devices connected to transmission means may be located elsewhere at or below the tool assembly 2. The alternative devices may be connected to the well tubular 4, supported by a wireline, imbedded into one or more formations, or otherwise located and supported within or near the wellbore 3.

In other alternative embodiments, the cable 7 may be passed through the tool assembly 2, coiled or otherwise located under surface G rather than running alongside the tool 2 as shown. The cable 7 may also be supplemented or replaced with other devices to be protected from the perforating charges, e.g., instrumentation, tubing, fiber optic cables, ducted passageways, or other means for transmitting electric current, electromagnetic pulses, fluid flow/pressure, or other signal media. In still other alternative embodiments, the upper signal-handling means 9 may be remotely located from the well and it may also be supplemented or replaced by a power supply, controller, data processors, fluid processors, or other transmission processing devices.

In one embodiment, a signature element or signal emitter is added to the cable 7 to form a detectable cable assembly 7*a* that extends across formation thickness T, preferably a radioactive gamma-ray emitter is added to the cable. The radioactive emitting portion of cable assembly 7*a* preferably produces at least about 0.01 microcuries/foot (0.01 microcuries per 0.30 meters), more preferably at least about 0.1 microcuries/foot (0.1 microcuries per 0.30 meters) as a position signal. In one embodiment, the radioactive emitter can take the form of an irradiated cobalt-alloy wire running parallel to a copper or other electrically conductive wire within a protective stainless steel and/or encapsulating plastic sheath of cable 7. Examples of an encapsulating plastic material include Halar, Hylar and Santoprene. In another embodiment, the signal emitter component of cable assembly 7*a* may take the form of a radioactive material compounded with or added to the encapsulating plastic instead of a separate irradiated wire. In still other embodiments, the radioactive emitter component of the cable assembly 7*a* can take the form of a series of separated radioactive sources along a portion of the length of the cable 7, an irradiated electrically-conductive wire (avoiding the need for a separate emitting wire), radioactive materials compounded with an electrically conductive wire, radioactive materials compounded with shielding or grounded components of the cable, or an irradiated protective sheath.

The selection of radioactive materials depends on the length of time a position signal is needed, the sensitivity of the directional detector, and limits imposed by safe handling procedures. Preferred radioactive materials have a half-life at least comparable to the length of time a position signal is needed. For example, if a single perforating process is expected to be accomplished within about a month after irradiation, an irradiated cobalt 60 alloy may be used.

In still other embodiments, a signature element or another position-signal emission source may be added to the cable 7 in place of a gamma-ray emitting material. Added signature elements can include high density materials such as lead (e.g., detectable by directional gravity sensors in tool assembly 2), magnetic materials (detectable by directional EMF sensors), color coating (e.g., detectable by downhole video cameras), electrically conductive or insulating materials (e.g., detectable by directional logging tools), and cable protuberances, e.g., detectable by feelers or other downhole contacting devices. Still other emission sources can include beta ray emitters, impressing an alternating carrier current or other electromagnetic signal-generating potential in the conductive wire portion of cable 7 (e.g., detectable by a directional EMF sensor in the tool assembly 2), other electromagnetic emitters and detectors, fluid pressure/pulsing sources or other acoustic/pressure wave signal emitters in cable 7 (e.g., detectable by a directional seismic or other acoustic sensor in assembly 2), and a heat or light emitter in cable 7, e.g., detectable by a directional infrared detector in tool assembly 2.

The perforating and detecting tool assembly 2 shown in FIG. 1 consists primarily of a perforating subassembly or means for directionally perforating 10, a partially shielded radioactive or other directional signal or signature detecting means 11, and a motor support member 12 or other means for supporting and orienting the assembly. Other components may include a centralizer, rotation actuator, casing collar locator, shock sub, phased perforation charges, radiation shield, and instrumentation to determine inclination.

When the perforating charges PC in the perforating subassembly 10 are actuated in an oriented position, a portion of the casing 4 and the formation of interest F are penetrated, typically using one or more explosive perforating cartridges and/or projectiles PC. As shown, the perforating charges PC are not equally spaced around the circumference of the tool assembly 2, but are concentrated in a direction opposite to the location of devices to be protected such as cable 7. By orienting the perforating charges PC in conjunction with and opposite to the orientation of the position sensor 11 when detecting the cable emitter or signature element (also see FIGS. 3 & 4), the perforating charges PC are directed away from the cable 7 and will avoid damaging the cable. A variety of perforating charges PC can be used as long as they are not omnidirectional. Other means for directed perforating could include shaped charges, explosive bolts, and rupturing pressurized fluid containers that are partially contained.

Figure 3:
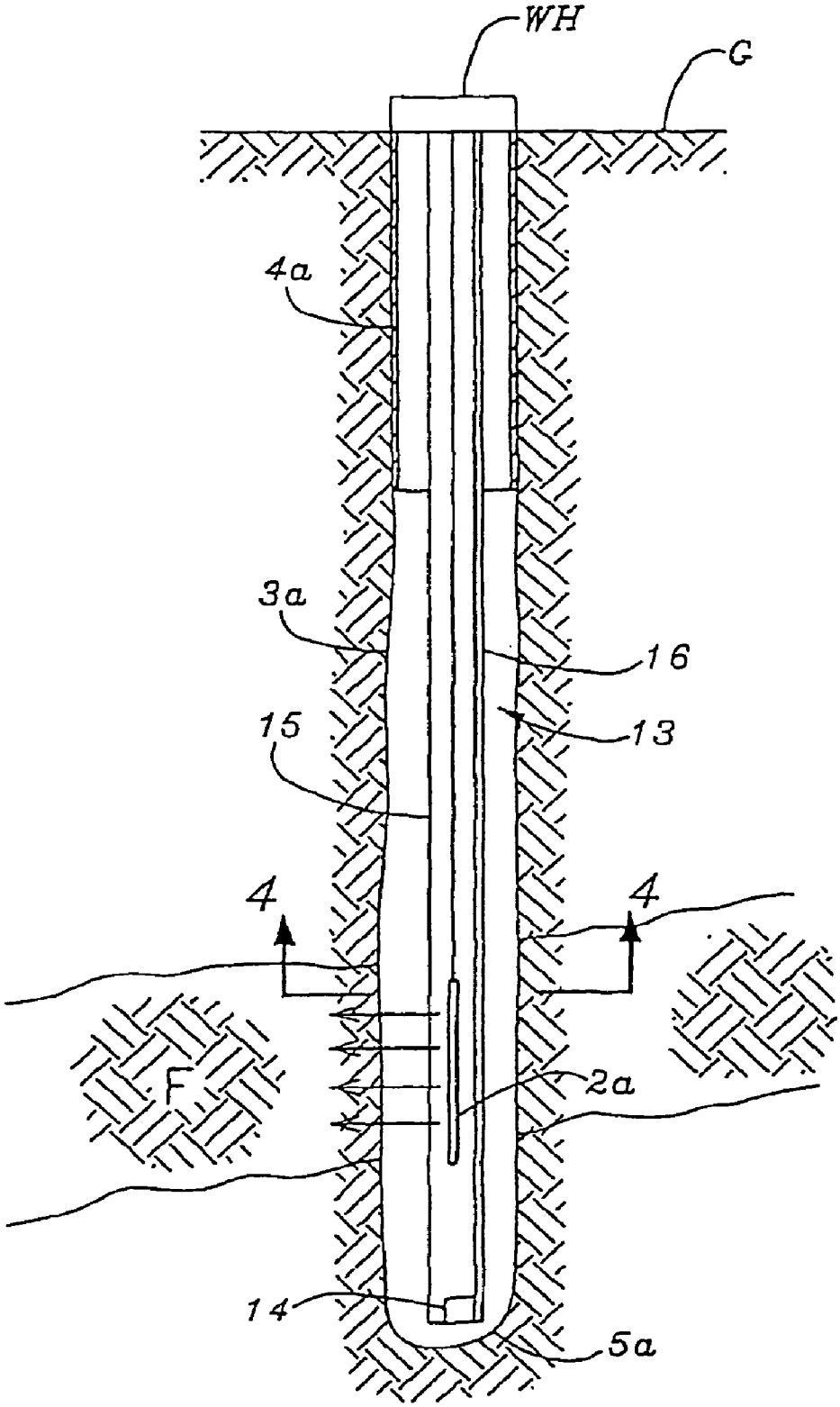
FIG. 3 shows a side schematic view of another embodiment of an inventive assembly within an underground wellbore.
Figure 4:
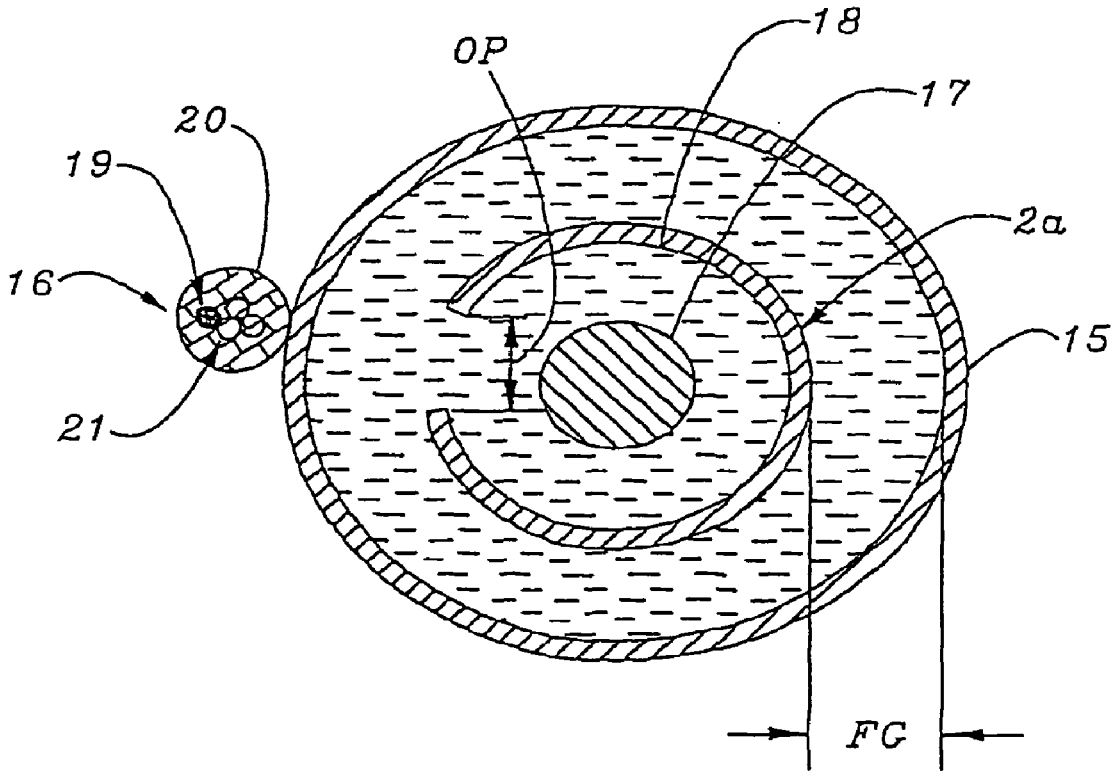
FIG. 4 shows a cross-sectional view taken at 4-4 as shown in FIG. 3.

In the embodiments shown in FIGS. 1, 3, & 4, the directional gamma-ray detector or transmitter position sensor 11 is part of the detecting and perforating tool assembly 2 and is attached to and rotated with the perforating subassembly 10. This tying together of opposite orientations of the detector and perforating means may avoid the need for separate detecting and orienting steps. In other embodiments, an alternative position sensor 11 may be spaced apart from the perforating subassembly 10, supported separately from the perforating subassembly, combined with the perforating subassembly but not rotated or oriented in conjunction with the perforating subassembly, e.g., used as part of a two step program whereby the first run would be for cable detection and/or formation mapping purposes and a second run would be for orientation and perforation.

Figure 2:
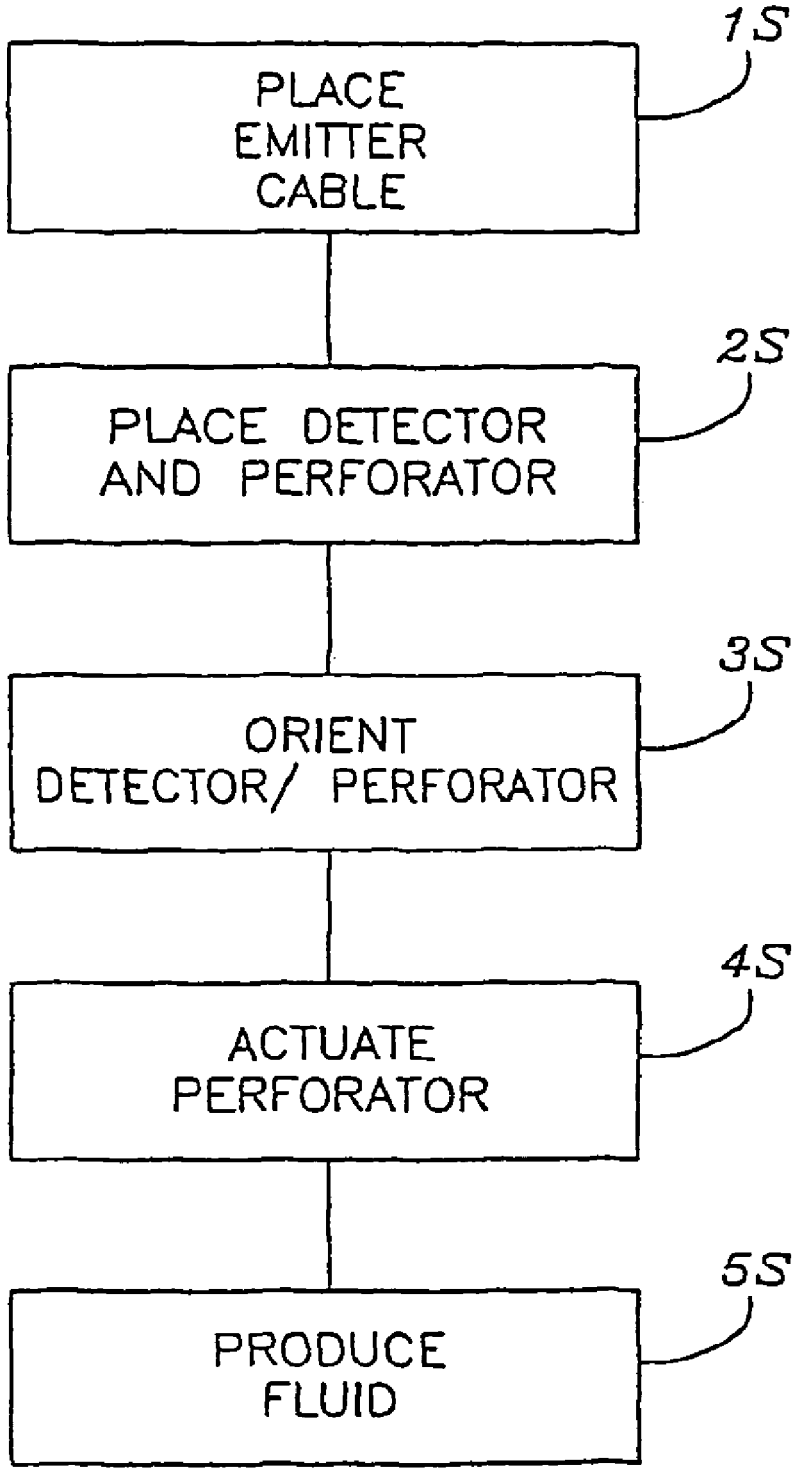
FIG. 2 shows a process flow diagram of an inventive method using the assembly shown in FIG. 1.

The process of using the detecting and perforating tool assembly 2 illustrated in FIG. 1 is shown in FIG. 2. The initial placing step is runs a cable assembly 7*a* (including a cable-position signal emitter or other position-detectable element) into a well. The initial placing step 1*s* positions a portion of the cable assembly 7*a* with the detectable element proximate to at least a portion of a formation of interest as shown in FIG. 1. After the cable assembly 7*a* is placed in the well, FIG. 2 shows a second placing step 2S places a position detecting and a well perforating means in the well. The position detecting means is capable of detecting the azimuthal orientation of the signature element or position-signal emitter (and the associated transmitting means) within the wellbore. In an orienting step 3S, the perforating means is oriented substantially away from the signal transmitting means based at least in part on the detected signal or signature orientation produced by the detecting means with the detector detecting the orientation of the signature element or position-signal emitter. After the orienting step 3S and in the absence of removing the detector or another running step, the perforating means is actuated in a perforating step 4S to penetrate the casing and/or formation of interest followed by a fluid production step 5S. In an alternative procedure if cables or other devices are dangerously close to the portion of the formation to be perforated, the position-signal detector and perforating tool is run into the well twice, with the first run orienting and mapping locations followed by a second run relocating endangered cables or other devices and actuating the perforating means in the desired azimuthal orientation.

In another alternative process, use of a downhole gamma ray detecting device is combined with a process step for detecting radioactive tracers injected into the formation. In this added process step, a radioactive tracer fluid is injected into various formations of interest and the downhole radiation detector is used to monitor the changes in radioactivity proximate to the formations of interest prior to the step 4S of actuating the perforator. The monitored changes in radioactivity are correlated to tracer fluid motions and are used, at least in part, to determine which formations of interest to perforate as well as the optimum orientation of the perforations.

In still another alternative process embodiment, a downhole radioactive detector is used after the perforating step 4S to help determine the portion of an injection fluid (such as water in a water flood production process) flowing into the formation of interest. A radioactive tracer is added to an injection fluid that is injected into the formation of interest. Upon later injecting and/or producing fluid from this well or other wells with detectors, the radioactive detector can be used to help determine the fluid flow patterns within the formation.

FIG. 3 shows a side view of another embodiment of the inventive tool assembly 2*a* within an underground wellbore 3*a*. The tool assembly is run into a 7-inch (18 cm) nominal diameter casing 4*a* that extends downward from a wellhead WH within the wellbore 3*a*. In alternative embodiments, a casing and/or liner 4*a* can extend from at or near the ground surface G to the well bottom 5*a*.

As shown in FIGS. 3 and 4, a tubing assembly 13 (including tubing string 15) is run into the casing 4*a* and wellbore 3*a* supporting a perforating and detector tool assembly 2*a*. The multiple horizontal arrows shown in FIG. 3 penetrating the formation of interest F from the tool assembly 2*a* illustrate the directed orientation of the non-uniform perforating action with the wellbore 3*a*. The tubing assembly 13 is run into the wellbore 3*a* until it passes the formation of interest F to a desired depth, or until a fluid control device 14 attached to the tubing assembly 13 is located proximate to the well bottom 5*a*. In this embodiment, the tubing assembly 13 includes an encapsulated control line 16 attached to a 2⅞ inch (7.3 cm) nominal diameter tubing string 15. The control line 16 is generally attached to the exterior of the tubing string 15, but in alternative embodiments, the control line may be unattached or may be attached to the interior of the tubing string.

The power cable or control line 16 includes an irradiated cobalt alloy wire producing gamma rays extending over at least a portion of the control line and producing at least about 0.01 microcuries per foot (0.01 microcuries per 0.30 meters), preferably at least about 0.1 microcuries per foot (0.1 microcuries per 0.30 meters) or more. The irradiated portion of the wire in the power cable 16 typically extends over a distance of at least a few inches, more typically several feet or meters. Longer irradiated wire sections and/or more sensitive detectors may allow the use of irradiated wire in power cable 16 producing less radiation per foot in alternative embodiments. In other alternative embodiments, using a short half life radioactive material, short wire sections and/or less sensitive detectors may require an irradiated wire producing significantly more than 0.1 microcuries per foot (0.1 microcuries per 0.30 meters), such as at least about 1 microcurie per foot (1 microcurie per 0.30 meters).

In the embodiment shown, a string of tubing sections 15 extends from the ground surface G to at or near the well bottom 5*a* within wellbore 3*a*. In other embodiments, several different diameters of tubing and/or casing sections may be used to comprise the casing and tubing strings 4*a* & 15, the casing string may terminate prior to the well bottom 5*a*, the tubing string may be cemented in place, and one or more tubing strings may be used.

FIG. 4 is a cross-sectional view of the embodiment shown in FIG. 3 at section 4-4. In this embodiment, the tubing string 15 is composed of N-80 steel sections having a nominal outside diameter of 2⅞ inches (7.3 cm) and a wall thickness of about 0.31 inches or 0.79 cm. Fluid typically occupies the fluid gap FG between the interior of tubing string 15 and the tool assembly 2*a*, nominally about a ½ inch (1.3 cm) concentric fluid gap in this embodiment. In order to maintain this fluid gap FG, spring-loaded fingers, centralizers, standoffs, or other positioning means may be used to generally locate the tool assembly 2*a* in the center of the wellbore 3*a*.

The tool assembly 2*a* comprises a gamma ray detector 17 within a rotatable shield 18 having an aperture or opening OP, preferably an opening measuring at least about ¼ inch or 0.63 cm, more preferably at least about ½ inch or 1.3 cm. The rotatable shield 18 is preferably composed of a tungsten alloy, but other radioactive shielding materials may be used. By rotating the apertured shield 18 with opening OP, the orientation of a gamma ray source 19 within the power cable 16 can be determined by the detector 17 since little or no signal will be generated by the detector unless the opening OP of the shield 18 is positioned between the source 19 and the detector.

In the embodiment shown in FIG. 4, the irradiating portion of the power cable 16 comprises a cobalt alloy source 19, an encapsulating material 20, and three capillary tubing strings 21. The attachment of the power cable 16 to the tubing string 15, e.g., by strapping, can provide an offset of about 0.6 inches (1.5 cm) from the OD of the tubing string 15 to the irradiated alloy wire 19. Alternatively, the irradiated wire may be proximate to the tubing string 15. The preferred irradiated cobalt 60 wire produces about 3-4 microcuries for a nominal 20-foot (6 meter) section of wire, but a similar length of cobalt alloy wire producing about 1-2 microcuries may also be used in some applications. In an alternative embodiment instead of an irradiated wire 19, one or more capillary tubing strings 21 may be filled with a detectable fluid, such as a fluid having a radioactive tracer that can be detected by an orientation sensor.

The encapsulating material 20 of the power cable 16 preferably comprises a non-electrically conductive plastic to form an insulating barrier. The encapsulating material 20 also cushions and protects the interior components of the power cable 16 from some environmental hazards. The encapsulating material 20 forms the exterior portion of the power cable 16 having a maximum diameter of about 0.75 inches (1.9 cm) for this embodiment.

Each of the three capillary tubing strings 21 has a diameter of approximately ¼ inch (0.6 cm) with a nominal 0.035 inch (0.089 cm) wall thickness in this embodiment, however, other diameters and wall thicknesses may be used. The wire 19 and capillary tubing strings 21 are typically twisted within the power cable 16 about one turn for every 20 feet (6 meters) of the cable. Alternative embodiments may use other cable or tubing attachment means, multiple wires (with one or more wires being a source of radiation or other orienting signals), more or less twisting per unit length, and more or less capillary tubing strings within the encapsulated assembly.

Figure 5:
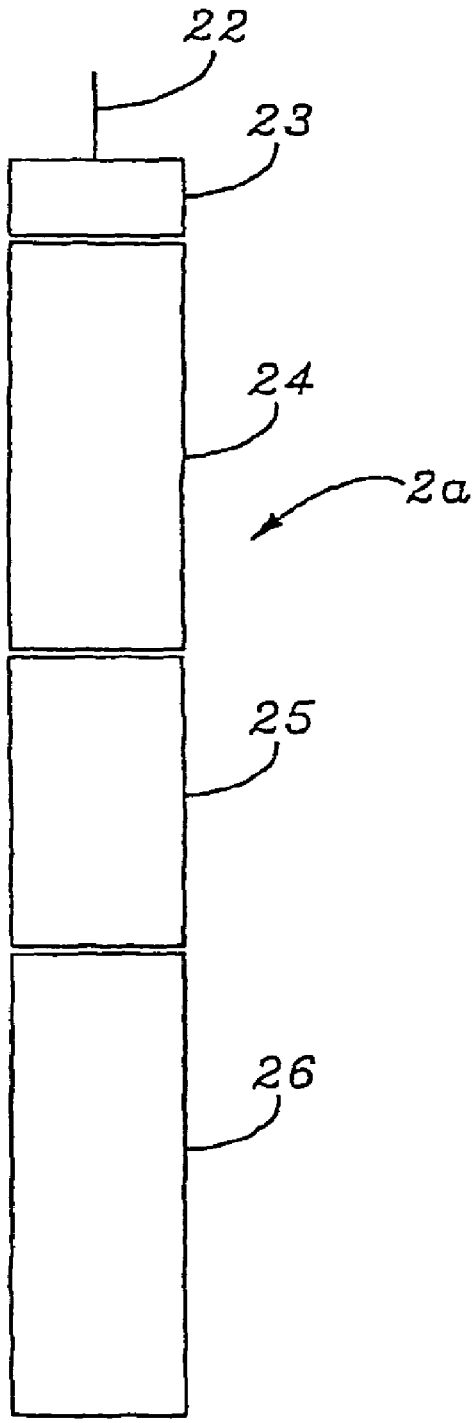
FIG. 5 shows a schematic side view of one embodiment of a perforating and detecting tool.

FIG. 5 shows a schematic side view diagram of the detecting and perforating tool assembly 2*a* shown in FIGS. 4 & 5. A slickline or wireline 22 supports the tool assembly 2*a*, preferably allowing the tool assembly to be run into a wellbore 3*a* (see FIG. 3) and a portion to rotate within the wellbore. Attached to the slickline 22 is a hold down/centralizer 23 or other means for securing and generally positioning the tool assembly 2*a* near the center of the wellbore 3*a* (see FIG. 3). Attached to the hold down/centralizer 23 is a motor section 24 that rotates the attached focusing and position-signal emission detector 25. The emission detector 25 is directionally adjustable to detect gamma ray radiation from a position-signal emitter and power cable 16 (see FIG. 3) indicating the azimuthal orientation of a downhole cable with reference to the orientation of the perforating means 26, preferably by means of an apertured shield connected to a rotatable perforating means 26, both of which are rotated by the motor section 24. In a similar embodiment, the directional radiation detector portion of the assembly may be as described in SPE paper number 38589, "Enhancing Frac-Pack Evaluations with Directional and Spectral Gamma Ray Measurements."

The perforating gun or other perforating means 26 is preferably attached to the rotatable portion of the oriented radiation detector 25. Preferably, the directional explosions from some or all of the perforating charges in the perforating gun 26 are oriented away from the focused or apertured direction in the gamma detector 25 that indicates the direction of the power cable shown in FIG. 3. This allows the perforating gun 26 to be automatically positioned at the desired azimuthal orientation when the radiation detector 25 detects the maximum signal strength emanating from the gamma ray emitter and power cable 16 shown in FIG. 3.

Further advantages of the orienting invention include improved perforating safety and reliability by assuring proper azimuthal orientation, reduced cost for multiple perforations by avoiding multiple entries (e.g., directionally discharging only a portion of the perforating charges at one location and directionally discharging another portion at a second location), and allowing multiple perforations in one wellbore having different azimuthal directions. When combined with other process steps especially for smart well completions, other advantages of the improved orienting invention include limiting the cost and time required for combined process steps and improved reliability of smart well control devices.

Still other alternative embodiments are possible. These include using multiple differently oriented perforating guns connected to a radioactive detector, means for reorienting a cable or other signal transmitting means such as circumferentially repositionable mechanical hooks extending from a tool supported within the wellbore, combining perforation and drilling and/or whipstock tools with a radioactive or other cable detecting means, replacing the perforating means with other formation penetrating means, using a controllable radioactive emitter in conjunction with a radioactive detector and tool assembly to calibrate the radioactive detector, and placing a radioactive detector within a thermal blanket or other environmentally protective enclosure.

This application discloses a signature element, which is attached to a downhole cable or other protected equipment; and the signal from a signature position detector is used, at least in part, to control the orientation of a directed perforating device or other directional device. Signal emitting sources can include a radioactive material added to an encapsulating composition of a downhole cable.

The Applicant reserves the right to claim or disclaim now or in the future any feature, combination of features, or subcombination of features that is disclosed herein.

All of the numerical and quantitative measurements set forth in this application (including in the description, claims, abstract, drawings, and any appendices) are approximations.

The invention illustratively disclosed or claimed herein suitably may be practiced in the absence of any element which is not specifically disclosed or claimed herein. Thus, the invention may comprise, consist of, or consist essentially of the elements disclosed or claimed herein.

The following claims are entitled to the broadest possible scope consistent with this application. The claims shall not necessarily be limited to the preferred embodiments or to the embodiments shown in the examples.

Although the preferred embodiment of the invention has been shown and described, and some alternative embodiments also shown and/or described, changes and modifications may be made thereto without departing from the invention. Accordingly, it is intended to embrace within the invention all such changes, modifications, and alternative embodiments as fall within the spirit and scope of the appended claims.

The invention claimed is:

1. A method of orienting a perforating device away from a cable in a well, the method comprising the steps of:

positioning a radioactive signature element in a known position relative to the cable, the positioning step including incorporating the signature element in the cable, and the incorporating step including providing the signature element as an irradiated wire;

detecting the signature element with a radiation detector;

orienting the perforating device away from the cable in response to the detecting step, the orienting step including orienting the perforating device away from the signature element; and conducting electricity through the irradiated wire.

2. A method of orienting a perforating device away from a cable in a well, the method comprising the steps of:

positioning a radiation detector in a tubing string with the cable, the cable being positioned within an annular space between the radiation detector and the tubing string;

positioning a radioactive signature element in a known position relative to the cable, the radioactive signature element positioning step further comprising incorporating the signature element in a grounded component of the cable;

detecting the signature element with the radiation detector; and orienting the perforating device away from the cable in response to the detecting step.

* * * * *